United States Patent [19]

Shimp et al.

[11] Patent Number: 4,603,313

[45] Date of Patent: Jul. 29, 1986

[54] CIRCUIT BREAKER WITH REPLACEABLE RATING PLUG INTERLOCK AND PUSH TO TRIP BUTTON

[75] Inventors: Alan B. Shimp, Monroeville Boro; William E. Beatty, Jr., Beaver, both of Pa.

[73] Assignee: Westinghouse Electric Corp., Pittsburgh, Pa.

[21] Appl. No.: 771,376

[22] Filed: Aug. 30, 1985

[51] Int. Cl.[4] ..... H01H 9/00

[52] U.S. Cl. ..... 335/172; 335/25; 335/42; 335/45; 335/166; 335/173; 335/176

[58] Field of Search ..... 335/25, 42, 45, 67, 335/166, 172, 173, 176; 337/55, 57, 68

[56] References Cited

U.S. PATENT DOCUMENTS 3,826,951 7/1974 Mater et al. ..... 361/100

*Primary Examiner*—E. A. Goldberg
*Assistant Examiner*—Lincoln D. Donovan
*Attorney, Agent, or Firm*—L. P. Johns

[57] ABSTRACT

A circuit breaker characterized by a pair of separable contacts, trip means operable automatically in response to overload current conditions to open the contacts which means include a rotatable trip bar biased in an untripped position, and interlock means including a manually operable button for rotating the trip bar to a tripped position when the button is pushed and for rotating a cam into tripped and untripped positions when the button is rotated.

17 Claims, 11 Drawing Figures

FIG. 2
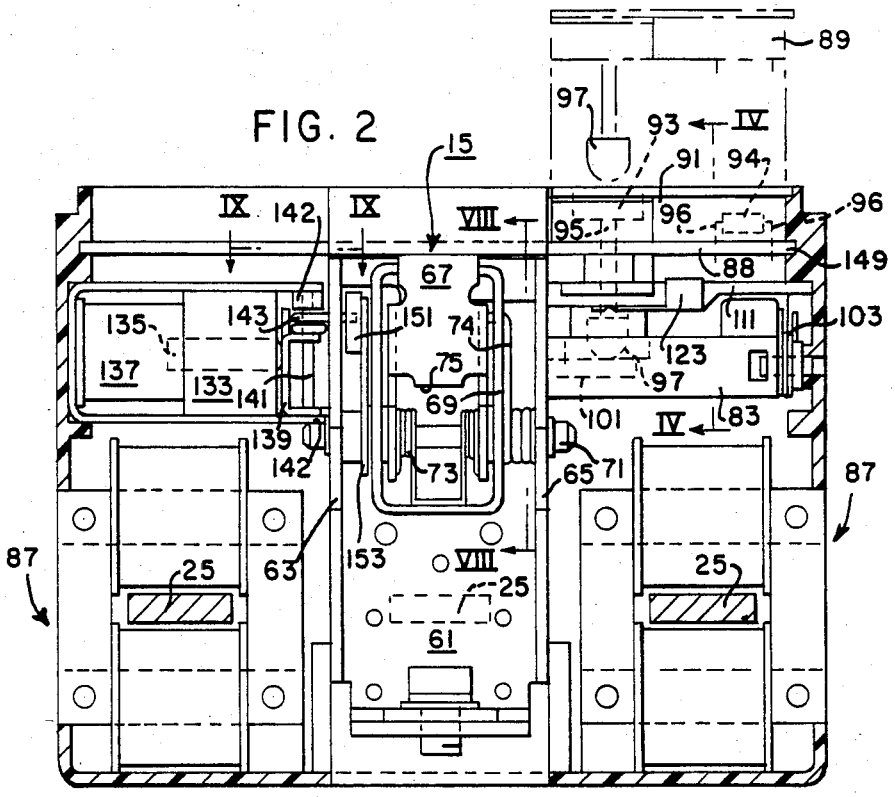
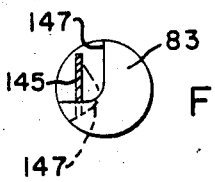
FIG. 11
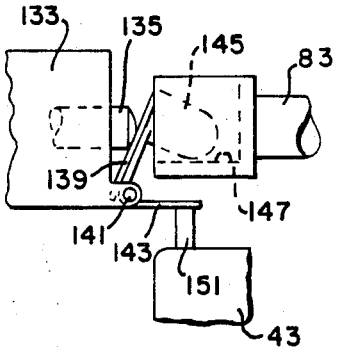
FIG. 9
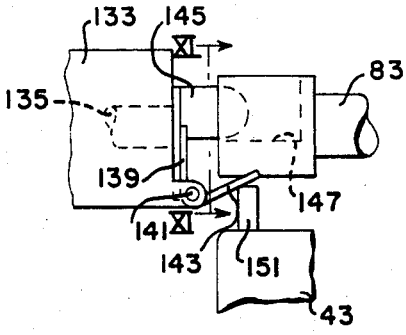
FIG. 10

CIRCUIT BREAKER WITH REPLACEABLE RATING PLUG INTERLOCK AND PUSH TO TRIP BUTTON

CROSS REFERENCE TO RELATED APPLICATION

Cross-reference is made to the copending application of Alan B. Shrimp, Ser. No. 771,377 (W. E. Case 52,666), which application is filed concurrently herewith.

BACKGROUND OF THE INVENTION

1. Field of the Invention

This invention pertains to circuit breakers of the type comprising a latched stored-energy mechanism releasable to effect tripping and, more particularly, it pertains to trip means automatically operable in response to overload conditions to effect release of the releasable mechanism.

2. Description of the Prior Art

In recent years, some circuit breakers with electronic trip units have employed replaceable rating plugs which comprise a resistor and an interlock means. The resistor is used to calibrate the electronic trip circuit. Rating plugs containing resistors of different values enables a rating change of the circuit breaker in the field. Interlock means are used to automatically trip the circuit breaker if the circuit breaker is closed when the rating plug is removed and to maintain the circuit breaker in a tripped condition as long as the rating plug is removed.

Interlock means employed in the past have consisted of a threaded device which when turned a number of full 360° rotations pulls against a spring and moves a lever away from a trip latch so that the circuit breaker can be reset and closed. Such an interlock requires a careful and precise adjustment at the time of manufacture to ensure proper operation. Moreover, the user is required to turn the rating plug screw several full turns before the breaker can be reset and closed. One prior art circuit breaker is disclosed in the patent to Alfred E. Maier and Alan B. Shimp, U.S. Pat. No. 3,826,951.

SUMMARY OF THE INVENTION

It has been found in accordance with this invention that a circuit breaker may be provided which comprises a circuit breaker structure supported within an electrically insulating housing which structure includes a pair of separable contacts operable to open and close an electric circuit, a releasable mechanism, manually operable means manually operable when the releasable mechanism is in a latched position to open and close the contacts, trip means operable automatically in response to overload current conditions above a predetermined value to release the releasable mechanism whereupon the releasable mechanism automatically moves from the latched position to a tripped position to open the contacts, the manually operable means being operable to move the releasable mechanism from the trip position to the latched position following release of the releasable mechanism, latch means operable between the latching and unlatching positions and biased in the former position to latch the releasable mechanism, the trip means including an externally accessible replaceable rating adjuster removably supported on the housing, interlock means automatically maintaining the releasable mechanism in the tripped position when the replaceable rating adjuster is removed from the housing, a trip bar extending between the adjuster and the latch means and biased in the untripped position, the interlock means including a trip button movable longitudinally to a protracted position to trip the trip bar, the interlock means also including a rotatable cam for locking the trip bar in the tripped position and the rotatable cam including a bore through which the trip button extends, and the trip button being rotatable to turn the rotatable cam between tripped and untripped positions of the trip bar.

BRIEF DESCRIPTION OF THE DRAWINGS

FIG. 2 is a vertical sectional view taken on the line II—II of FIG. 1;

FIG. 9 is a horizontal sectional view taken on the line IX—IX of FIG. 2;

FIG. 10 is a view similar to FIG. 9 with parts in alternate positions; and FIG. 11 is an end view taken on the line XI—XI in FIG. 10.

DESCRIPTION OF THE PREFERRED EMBODIMENT

Figure 1:
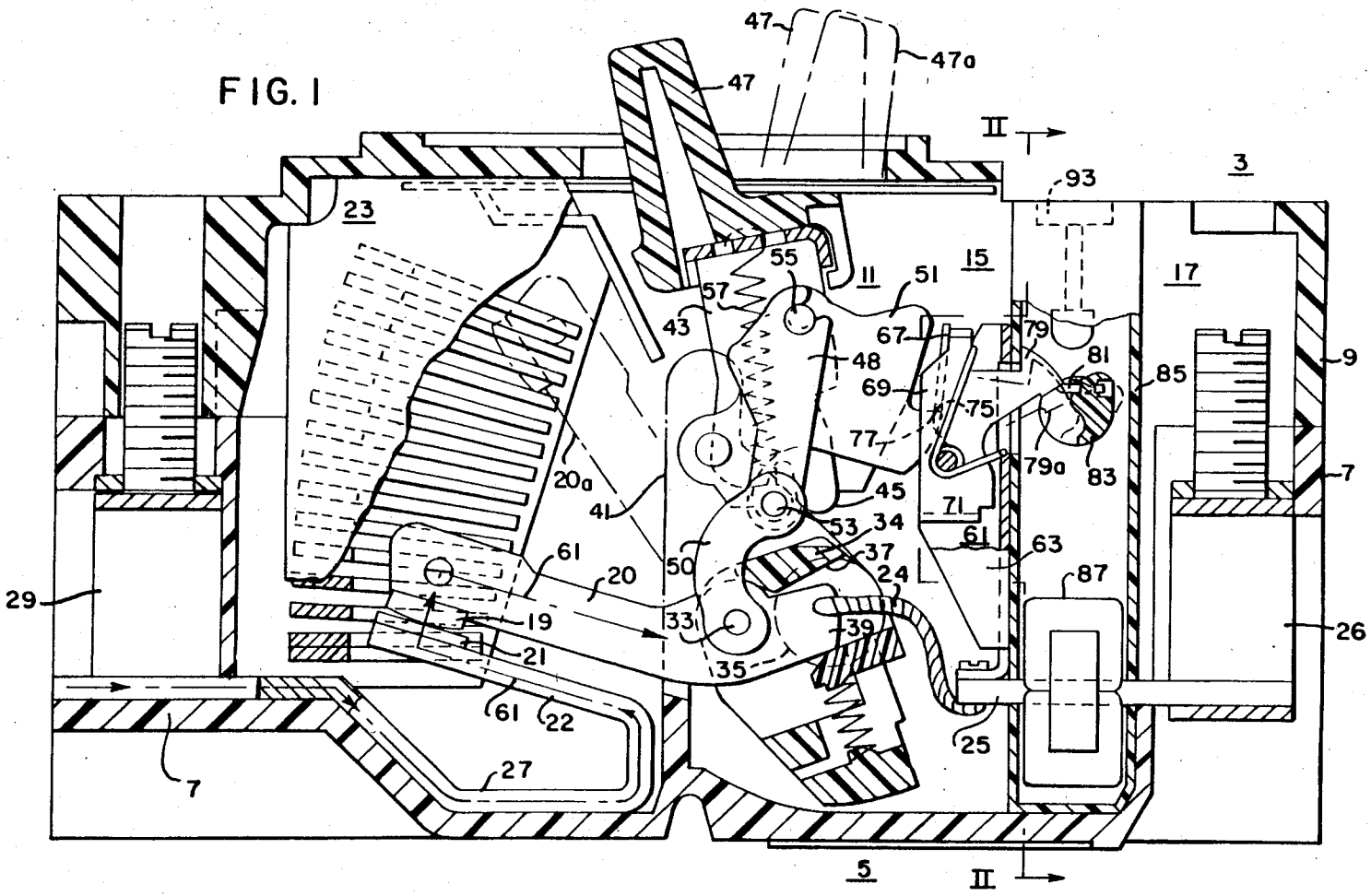
FIG. 1 is a vertical sectional view, with parts broken away, through the center pole unit of a three-pole circuit breaker.

A three-pole circuit breaker, generally indicated at 3 in FIG. 1, comprises an insulating housing 5 including a base 7 and a cover 9 which is secured to the base in a conventional manner such as by screws (not shown). Although the principal of this invention is applicable to a single pole circuit breaker, it is usually applicable to a multi-pole unit for which reason the housing 3 comprises insulating barriers separating the housing into three adjacent side-by-side pole unit compartments in a manner well known in the art.

Within the housing a circuit breaker mechanism 11 is mounted within the center pole unit of the housing and comprises a single operating mechanism and a latch mechanism 15. The circuit breaker mechanism 11 also comprises a high speed electromagnetic trip device 17.

Each pole of the circuit breaker includes a pair of separable contacts 19 and 21, attached to upper and lower contact arms 20 and 22, respectively. An arc extinguishing unit or arc chute 23 is provided in each pole unit. The upper contact 19 is electrically connected, through the upper contact arm 20 (constructed of conducting material), to a shunt 24 which is connected through a conducting strip 25 and through the trip device 17 to a terminal 26.

The lower contact 21 is connected through the lower contact arm 22 and a conducting strip 27 to a terminal 29. With the circuit breaker 3 in the closed position, an electrical circuit thus exists from the terminal 29 through the several items 27, 22, 21, 19, 20, 24, 25, to the terminal 26.

The contact arm 20 is pivotally connected at pivot pin 33 to a rotatable carriage 34 which is fixedly secured to an insulating rotatable tie bar 35. The carriage 34 includes a slot or pocket 37 in which an end portion 39 of the arm 20 is mounted on the pivot pin 33. The arm 20 and the carriage 34 rotate as a unit with the tie bar 35 during normal current conditions through the circuit breaker.

The single operating mechanism 11 is positioned in the center pole unit of the three-pole circuit breaker and is supported on and between a pair of rigid support plates 41 (one of which is shown) that are fixedly secured in the base 7 in the center pole unit of the breaker. An inverted U-shaped operating lever 43 is pivotally supported on the spaced plates 41 with the ends of the legs of the lever positioned in U-shaped notches 45 of the plates. The operating lever 43 includes a handle 47 of molded electrically insulating material.

The contact arm 20 for the center pole unit is operatively connected by means of a toggle comprising an upper toggle link 48 and lower toggle link 50 to a releasable cradle member 51. The toggle links are pivotally interconnected by means of a knee pivot pin 53. The lower toggle link 50 is pivotally connected to the carriage 34 of the center pole unit by the pivot pin 33 and the upper toggle link is pivotally connected to the releasable cradle member 51 by a pivot pin 55. Overcenter operating springs 57 are connected under tension between the pivot knee pin 53 and the bight portion of the operating lever 43.

The contacts 19, 21 are manually opened by movement of the handle 47 from the ON position (FIG. 1) to an OFF position to the right of that shown in FIG. 1. Movement of the handle 47 to the right (to the OFF position) carries the line of action of the overcenter operating springs 57 to the right, causing collapse of the toggle links 48, 50 and to rotate the tie bar 35 in a clockwise direction to simultaneously move the contact arm 20 of the three pole units to the open position and thereby opening the contacts of the three pole units. The contact arm 20 is then in the broken line position **20*a* (FIG. 1**).

The contacts are manually closed by reverse movement of the handle to the left which movement moves the line of action of the overcenter springs 57 to the left to move the toggle links 48, 50 to the position shown in FIG. 1. This movement rotates the tie bar 35 in a counterclockwise direction to move the contact arms 20 of the three pole units to the closed position.

The releasable cradle member 51 is latched in the position shown in FIG. 1 by means of the latch mechanism 15 which is a lever actuated by the trip device 17. The trip device 17 is capable of detecting both low level short circuit or overload current conditions and high level short circuit or fault current conditions. Upon the detection of any such condition the trip device 17 actuates the latch mechanism to initiate the trip operation of the circuit breaker mechanism 11.

The latch mechanism 15 (FIG. 2) comprises a U-shaped mounting frame 61 having spaced legs 63, 65, a latch lever 67, and a trip lever 69. Both levers 67, 69 are pivotally mounted on a pin 71 which is journaled in the legs 63, 65. A spring 73 biases the latch lever 67 clockwise against upper portions of the trip lever 69 which is biased counterclockwise by a spring 75.

Figure 8:
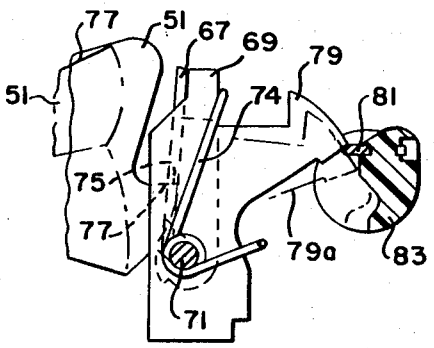
FIG. 8 is a fragmentary sectional view, taken on the line VIII—VIII of FIG. 2.

The latch lever 67 includes a surface 75 that engages a notch surface 77 of the cradle member 51 when the member is in the latched or untripped position (FIGS. 1, 8). Because of the pressure applied to the circuit breaker mechanism 11 by the springs 57, the cradle member 51 remains in the latched position with the surfaces 75, 77 engaged. The latched position of the releasable member 51 is sustained by backup pressure applied by the upper end of the trip lever 69 against the upper end of the latch lever 67 which in turn is reinforced by a flange 79 which is held in place against clockwise rotation about the pin 71 by a detent 81 on a trip bar 83 as set forth hereinbelow. Suffice it to say, when the trip bar 83 is rotated clockwise through a small arc the pressure of the springs 57 (FIG. 1) rotates the trip lever 69 clockwise to a broken line position **79*a*, thereby releasing the surface 77 from the surface 75 of the latch lever 67. Accordingly, the cradle member 51 moves to the broken line position 79*a* (FIG. 8) which permits the torsion spring 74 to return the trip lever 69 as well as the latch lever 67** counterclockwise to their original positions.

After being tripped the circuit breaker mechanism 11 may be reset to the untripped position by moving the handle 47 counterclockwise to position **47*a* and return the surface 77 to a latched position under the surface 75 of the latch lever 67 which in turn yields slightly clockwise against the torsion spring 73** which in turn returns the latch lever to the latched position.

The electromagnetic trip device 17 is contained within in insulating box-like container 85 which is detachably mounted within the circuit breaker 3. It contains a current transformer 87, for each pole unit, an electronic circuit board 88, the trip bar 83, and an interlock assembly 89 (FIG. 2) which includes a replaceable rating plug interlock assembly 91, and a push-to-trip button 93. The interlock assembly 89 is a replaceable rating plug which as shown in FIG. 2, is detachably mounted for replacement by a similar rating plug of a different rating. Generally, the rating plug includes a resistor 94 of a specific resistance for a desired rating. The resistor 94 is connected between connector pins 96 on the rating plug. When the plug is inserted into the unit, connector pins 96 make contact with matching receptacles in the circuit board 88, thereby calibrating the trip unit to a particular rating.

Figure 4:
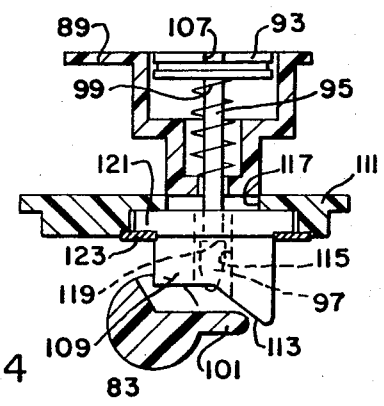
FIG. 4 is a vertical sectional view taken on the line IV—IV of FIG. 3.

When the circuit breaker is in the closed position and it is desired to manually trip the circuit breaker, the trip button 93 is used. The trip button is seated within the housing of the trip control assembly 89 and the button includes an elongated shaft 95 (FIGS. 4, 6) and an enlarged end portion 97 fixed to the lower end of the shaft. The shaft extends through a coil spring 99 in the housing for returning the button to the retracted position when it is released.

When the button 93 is depressed, the lower end strikes a projection 101 (FIG. 7) extending radially from the trip bar 83 and thereby rotates the trip bar clockwise to the trip position by moving the detent 81 (FIG. 8) from under the flange 79, thereby unlatching the cradle member 81 to open the contacts 19, 21.

When the trip button 93 is released the coil spring 99 returns the button to the retracted position (FIG. 4) whereupon a torsion spring 103 (FIG. 2) rotates the trip bar 83 counterclockwise to the untripped position. In that position the circuit breaker may be reset by moving the handle 47 (FIG. 1) clockwise beyond the trip position shown in FIG. 1 to relatch the cradle member as shown in the solid line position of the member 51 in FIG. 8.

When it is necessary to replace the rating plug interlock 105, the trip bar is turned to the trip position (FIG.

Figure 7:
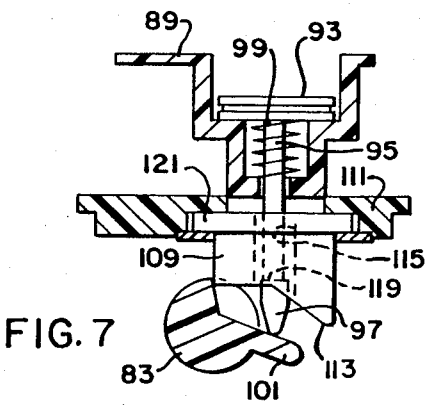
FIG. 7 is a sectional view, similar to FIGS. 4 and 6, showing the push button and trip bar in the tripped positions.
Figure 5:
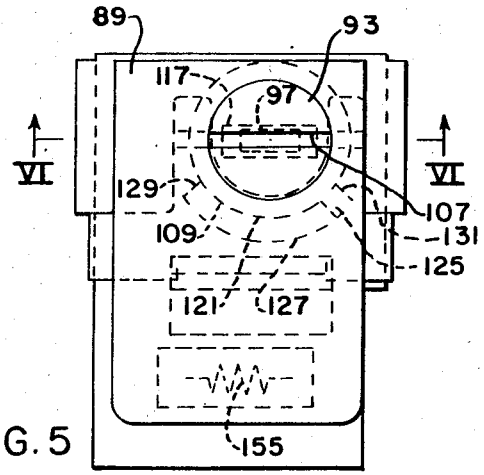
FIGS. 5 and 6 are views similar to FIGS. 3 and 4, respectively, with parts in alternate positions.

6) so that the circuit breaker contacts 19, 21 cannot be closed until a rating plug interlock is installed. For that purpose the trip button 93 is rotated, such as by inserting a screwdriver into a slot 107 in the top of the button. As shown in FIGS. 3–7 the trip button 93 functions with a cam 109 which is rotatably mounted in a cam mounting plate 111. The cam, includes a cam surface 113 and a bore 115. The bore has a non-circular cross-section which is preferably rectangular and accommodates movement of the enlarged end portion 97 having a similar and slightly smaller cross-section. Thus the enlarged end portion 97 is slidable through the bore 115, such as when the trip button 93 is advanced to trip the trip bar 83 (FIG. 7). When the trip button 93 is used for that purpose (to trip the trip bar 83), the cam 109 is in the position shown in FIGS. 4 and 7 with the cam surface 113 out of contact with the projection 101. When, however, the trip button 93 is rotated the enlarged end portion 97, being within the cam bore 115, rotates the cam until the cam surface 113 is in the position shown in FIG. 6 with the lower end of the cam in contact with the projection 101, thereby preventing return of the trip bar 83 to the untripped position. As a result the cradle member 51 cannot be reset and the contacts 19, 21 are in the open position.

Figure 6:
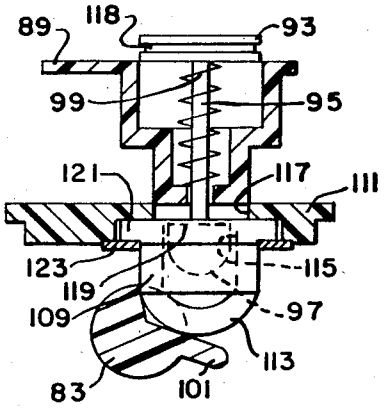
Figure 3:
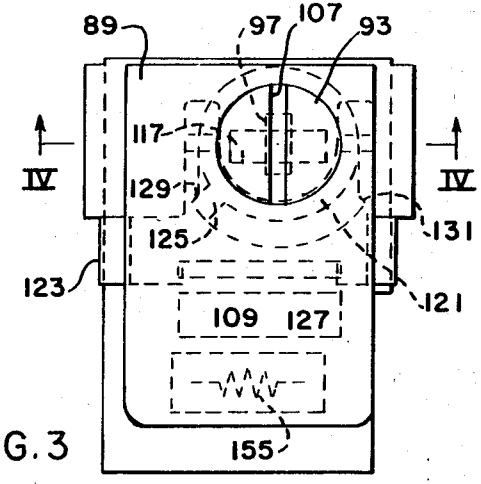
FIG. 3 is a fragmentary horizontal view taken on the line III—III of FIG. 1.

With the cam 109 in the position shown in FIG. 6, the cam bore 15 registers with a similar rectangular opening 117 in the cam mounting plate 111, so that the enlarged end portion 97 may be removed from the cam and through the opening 117 when it is necessary to remove the trip control assembly 89 for removal and replacement of the associated rating plug interlock 91. The enlarged end portion 97 includes a pair of similar oppositely extending shoulders 119. So long as the cam 109 is in the positions shown in FIGS. 4 and 7, the shoulders 119 are unaligned with the opening 117 in the cam mounting plate 111 so that the enlarged end portion 97 cannot be removed from the position shown.

On the other hand, when the button 93 is turned in the position shown in FIG. 6, the enlarged end portion 97 is aligned with the opening 117 (FIG. 5) and spring 99 causes the button to protrude above the surface of the rating plug 89. With the button protruding a user can grasp the button by means of a groove 118 to lift the rating plug from the trip unit. When the button is rotated to the position of FIG. 4, it does not protrude above the rating plug surface and it is therefore impossible to grasp the button and lift the trip unit from the rotating plug.

As shown in FIGS. 3–7 the cam 109 includes a peripheral flange 121 which is seated within a recess of the cam mounting plate 111 where it is secured by a retaining clip 123. A projection 125 (FIGS. 3, 5) extends outwardly from the flange 121 and is movable in a 90° arcuate portion 127 of the recess which arcuate portion includes opposite end surfaces 129, 131.

Upon the occurrence of overload current conditions a magnetic trip actuator 133 (FIGS. 2, 9, 10) automatically unlatches the latch mechanism 15 to release the cradle member 51. The actuator 133, being an electromagnetic device, comprises an armature plunger 135 that is maintained in the inoperative position (FIGS. 2, 10) by magnetic means 137 (FIG. 1). The armature plunger 135 functions in conjunction with a lever 139 that is pivotally mounted on a pivot pin 141 having opposite ends seated in an associated frame member. A torsion spring 143 is also mounted upon the pivot pin 141 for retracting the plunger 135 to the retracted position. The lever 139 includes a flange 145. When the armature plunger 135 is actuated to the extended position (FIG. 9), the lever 139 is rotated clockwise to cause the flange 145 to bear against a cam surface 147 on the end of the trip bar 83, thereby rotating the bar against the pressure of the torsion spring 103 (FIG. 2) to trip the circuit breaker mechanism 11.

Upon the occurrence of an overload in any of the pole units, the associated current transformer 87 senses the overload and operates through the static circuit board 98 (FIG. 2) to pulse the magnetic trip actuator 133 to thereby force the plunger 135 against the lever 139.

Subsequently, when the circuit breaker is reset by moving the handle 47 (FIG. 1) clockwise from the off position to the reset position **47*a*, the lever 43 moves against a link 151 which is mounted at the upper end of a lever 153 (FIG. 2) the lower end of which is pivotally mounted on the pivot pin 71. As a result (FIG. 9) the link 151 moves against the torsion spring 143 and moves it to the position shown in FIG. 10 to cause the lever 139 to force the armature plunger 135** into its retracted position.

In conclusion, the circuit breaker of this invention provides a combined trip button and rating plug interlock mechanism which operates to release or trip the circuit breaker as necessary. The trip button and the interlock comprise a detachable assembly whereby the rating plug may be replaced as necessary by rotating the trip button through an associated cam for holding the trip bar in the trip position.

What is claimed is:

1. A circuit breaker comprising:

a housing;

a circuit breaker structure supported in the housing;

the circuit breaker structure having a pair of contacts operable to open and close an electric circuit;

a releasable mechanism;

first manually operable means manually operable when the releasable mechanism is in a latched position to open and close the contacts;

trip means operable automatically in response to overload current conditions above a predetermined value to release the releasable mechanism whereupon the releasable mechanism automatically moves from the latched position to a tripped position to open the contacts;

the first manually operable means being operable to move the releasable mechanism from the tripped position to the latched position following release of the releasable mechanism;

latch means operable between latching and unlatching positions to latch the releasable mechanism;

trip means including an externally accessible replaceable rating adjuster removably supported on the housing;

interlock means automatically maintaining the releasable mechanism in the tripped position when the replaceable rating adjuster is removed from the housing;

a trip bar extending between the adjuster and the latch means and biased in the untripped position;

the interlock means including second manually operable means operable between retracted and protracted positions to move the trip bar to the tripped position; and the interlock means including third manually operable means operable between locking and unlocking positions of the trip bar; whereby the latch means is inoperable in the locking position.

2. The circuit breaker of claim 1 in which the trip bar is an elongated member rotatably movable between tripped and untripped positions.

3. The circuit breaker of claim 2 in which the second manually operable means includes a trip button movable longitudinally to the protracted position to trip the trip bar.

4. The circuit breaker of claim 3 in which the trip button is biased in the retracted position.

5. The circuit breaker of claim 4 in which the trip bar includes a transverse projection, and the third manually operable means comprises a rotatable member having a cam surface operable on the transverse projection.

6. The circuit breaker of claim 5 in which the rotatable member includes a bore through which the trip button extends.

7. The circuit breaker of claim 6 in which the bore has a non-circular cross-section, the trip button being slideable through the bore, and the trip button including manually turnable surface means for turning the rotatable member in response to turning the trip button.

8. The circuit breaker of claim 7 in which the rotatable member is rotatably mounted on a mounting plate having a hole aligned with and corresponding to the bore, and the trip button having an outturned shoulder engageable with the surface of the mounting plate when the rotatable member is rotated to cause misalignment of the cross sections of the bore and hole.

9. The circuit breaker of claim 8 in which the trip button is movably mounted in the housing and is biased away from the transverse projection.

10. The circuit breaker of claim 9 in which the rotatable member is rotatable through a limited arc between positions of engagement and disengagement with the transverse projection.

11. A circuit breaker comprising:

a housing;

a circuit breaker structure within the housing an having a pair of separable contacts operable to open and close an electric circuit;

a releasable mechanism;

first manually operable means operable only when the releasable mechanism is in a latched position to open and close the contacts;

trip means operable automatically in response to overload current conditions above a predetermined value to release the releasable mechanism from a latched position and to thereby open the contacts;

latch means operable between latching and unlatching positions to latch the releasable mechanism;

the trip means including an externally accessible replaceable rating adjuster removably supported on the housing;

interlock means automatically maintaining the releasable mechanism in the tripped position when the replaceable rating adjuster is removed from the housing;

a trip bar extending between the adjuster and the latch means and having a transverse surface at an angle to the axis of the trip bar;

a trip button biased on a retracted position through the housing and extendable to engage the transverse surface and to thereby rotate the trip bar to the tripped position;

a rotatable member having a cam surface movable upon rotation of the member into and out of tripping engagement with the transverse surface;

the trip button being connected to the rotatable member so as to cause rotation of the member into and out of tripping engagement with the transverse surface; and the trip button extending through a rectangular bore in the rotatable member and having a rectangular cross-section engageable and positioned in the rectangular bore for rotation of the member.

12. The circuit breaker of claim 11 in which the trip button is mounted on a support member that is detachably mounted on the housing and the rating adjuster is replaceably mounted on the support member.

13. The circuit breaker of claim 11 in which the trip button is partially retractable from the rating adjuster to enable grasping of the button o remove the adjuster from the housing.

14. The circuit breaker of claim 11 in which the rotatable member is mounted on a plate detachably mounted on the housing.

15. The circuit breaker of claim 14 in which the support member comprises a tubular portion in which the trip button is movably mounted in the tubular portion and in alignment with the rotatable member.

16. The circuit breaker of claim 15 in which the trip button includes a shaft extending in the tubular portion and having an enlarged shaft end portion disposed in the rectangular bore of the rotatable member, the button being movable longitudinally through the bore to engage and rotate the transverse surface to trip the trip bar, and the button being rotatable in the bore to turn the rotatable member into and out of tripping engagement with the trip bar.

17. The circuit breaker of claim 16 in which the rotatable member is mounted on the side of the plate opposite to the tubular portion, the plate including an aperture aligned with and corresponding to the rectangular bore of the member, the shaft end portion having an outturned shoulder surface engageable with the surface of the plate when the trip button and member are in the untripped position of the trip bar.

* * * * *